United States Patent [19]

Ecrepont

[11] Patent Number: 4,967,581

[45] Date of Patent: Nov. 6, 1990

[54] PROCESS FOR PRODUCING A ROLLED SECTION HAVING A CORRUGATED PART AND INSTALLATION INTENDED FOR THIS PURPOSE

[76] Inventor: Jean M. J. Ecrepont, Chemin des Trois Arbres 90, B-6428 Ham-sur-Heure, Belgium

[21] Appl. No.: 360,409

[22] Filed: Jun. 2, 1989

[30] Foreign Application Priority Data

Jun. 3, 1988 [BE] Belgium ..... 08800636

[51] Int. Cl.[5] ..... B21B 1/08

[52] U.S. Cl. ..... 72/187; 72/196

[58] Field of Search ..... 72/167, 187, 196

[56] References Cited

U.S. PATENT DOCUMENTS 1,106,172 8/1914 Wetcke ..... 72/187

4,597,278 7/1986 Hamada et al. ..... 72/187

FOREIGN PATENT DOCUMENTS 107222 6/1983 Japan ..... 72/196

16844 4/1984 Japan ..... 72/196

*Primary Examiner*—Lowell A. Larson

*Attorney, Agent, or Firm*—Fishman, Dionne & Cantor

[57] ABSTRACT

To produce an I-section (1) rolled in one piece, of which part (9) of the web (3) is corrugated, the section is passed between two rolls having an increased diameter over a portion of length, and it is subsequently passed between two rollers having a structured surface, so as to carry out a continuous uniform folding.

13 Claims, 2 Drawing Sheets

PROCESS FOR PRODUCING A ROLLED SECTION HAVING A CORRUGATED PART AND INSTALLATION INTENDED FOR THIS PURPOSE

SUBJECT OF THE INVENTION

The present invention relates to a process for producing rolled sections, such as a U or a beam, more especially an I-beam, having a corrugated part, particularly a flange or a web.

It also relates to a particular installation intended for this purpose.

STATE OF THE ART

The patent U.S. Pat. No. 4,251,973 makes known an I-beam having a corrugated web welded to the chords. It also describes a production process, in which a plane web is welded to a pair of chords and the beam thus formed passes between two rolls which swage the web of the beam in the desired way.

However, a beam of the abovementioned type is subjected to high internal stresses. In fact, the welding generates in the beam stresses which risk deforming it and/or warping its chords. Furthermore, the rolling of part of the web implies an elongation of this, the result being reduction of its thickness. Another result of this is high stresses on the welds between the web and the chords and internal stresses in the web because of the differential deformations. These stresses likewise risk deforming the finished beam and/or warping it. Moreover, these stresses can have an adverse influence on the behavior of the beam, especially on its mechanical resistance to the various forces to which it may be subjected during use. In addition, this process necessarily implies a weldable steel.

The document LU-A-No.-83,044 (SUMITOMO METAL) makes known a process for producing an I-beam with a corrugated web at its center, according to which corrugations are formed in the middle part of the web of a finished standard I-beam by means of two rolls which intermesh in a complementary manner. According to this process, the increase in the developed length of the corrugated web from the straight length of a plane web before the formation of the corrugations is obtained by reducing the thickness of the web under the effect of the work involved in forming the corrugations.

It emerges from the description and the drawings that the I-beam with a corrugated web is obtained from a finished standard beam by means of one or more rolling operations between two opposing structured rolls. In fact, the extra length is provided by reducing the thickness of the web as a result of the action of two structured rolls, thus obviously giving rise to internal stresses and appreciable cold straining of the material and thereby a bending or torsion of the I-beam. The proprietor of the abovementioned patent attempts to overcome this disadvantage by forming the corrugations in the web in two or more passes. However, the problem of the internal stresses is not solved at all, and moreover the process involves a somewhat high outlay.

The document FR-A-No. 744,933 makes known metal sections with a web of locally reduced cross-section, which are obtained by simple rolling.

This document does not mention the production of a rolled section having a corrugated part. Furthermore, the passage of a section of the type described in the steps of the process of patent LU-A-No. 83,044 (SUMITOMO) would result in a product, of which the cross-section of the reduced part would be further thinned by rolling, thereby leading to the same disadvantages as those set forth above.

OBJECTS OF THE INVENTION

According to the first aspect of the present invention, the latter seeks to provide a simple process for the production of a section of the abovementioned type, at a cost virtually equivalent to that of a normal beam.

Another object of the present invention is to provide a process for producing a section of the abovementioned type, which does not have the disadvantages of the processes known in the state of the art and which, more particularly, makes it possible to produce easily rolled sections possessing a corrugated part which has a minimum of residual tensions and internal stresses.

According to another aspect, the invention aims to provide an installation of a new type for the production of the said sections.

ESSENTIAL ELEMENTS OF THE INVENTION

According to the present invention, the rolled sections having a corrugated part, more particularly I-beams with a web corrugated over some of its height, are obtained in the following operational steps:

conventional rolling is carried out in a way known per se, until a blank close to finishing is obtained;

the blank so obtained is passed between two rolls, at least one of which has a larger diameter over a portion of its length, so as to give rise to an overlength on it;

shaping is carried out by the uniform and repeated folding of the corrugations obtained as a result of the preceding step.

The section rolled and treated according to the present invention is particularly resistant especially to bending and to buckling. As a result of this, for a desired mechanical resistance, the weight of the said section can be reduced. Moreover, because of the simplicity of the process and of the various steps employed, the price of the section obtained is lower than that of the other known types.

Furthermore, the process of the invention makes it possible to obtain a section, part of which has a corrugation, without the individual stresses or internal tensions being high. In fact, during the passage of the blank obtained in the first step of the process between two rolls or rollers, at least one of which has a larger diameter over some of its length, the space between the two rolls or rollers is therefore reduced locally. The local rolling of the web obtained in this way, over a distance less than its height contained between the chords, prevents the creep of the said chords. Besides, undesirable deformations of the flanges are prevented. The larger diameters of tee mill rolls over a portion of height of a section part, especially over a portion of the web of an I-beam, and consequently the reduction of the gap between the said rolls generate tensions which tend to elongate the corresponding portion of the section part and cause a corrugation of the said portion. In a third step, these corrugations are shaped by simple folding. In fact, since the corrugations obtained in the second step do not have the desired uniformity, this is achieved by a folding which also makes it possible essentially to eliminate the internal stresses induced in the preceding phase.

Contrary to the process of the invention, the process known from the document LU-A-83,044 practices a continuous rolling of the web of a finished rolled section in a single step. This of course results in high cold-straining stresses.

Advantageously, the percentage of additional elongation to be imparted to the portion of the section part to be corrugated is substantially equal to the percentage of overlength of the desired corrugation in relation to the straight line. It is thus guaranteed that straining stresses as possible and that the folding operation is not associated with a swaging.

According to a preferred embodiment of the invention, the shaping is carried out by folding between two rollers which are arranged in a plane essentially perpendicular to the direction of travel of the section and which have a structured surface, especially rollers with a surface grooved or splined in the axial direction over a length corresponding essentially to the part of larger diameter of the roller or roll of the second step and therefore to the portion of height of the section part which is corrugated.

In order to avoid the cold-straining of the material as far as possible and ensure a folding operation and not a swaging operation, the opposing structured rolls or rollers intermesh only slightly, so that the rolled product is folded in the manner of a girder on two supports which support a point load in the middle of its span.

The sections according to the present invention are especially suitable for uses requiring a high resistance and a low weight.

Especially with regard to a rolled I-section, the local rolling of the web over a distance less than its height contained between the two chords prevents the creep of the said chords. Furthermore, undesirable deformations of the flanges are also avoided.

The construction of rigid chassis of vehicles, especially trucks or public transport vehicles, may be mentioned by way of example.

Advantageously, the step of shaping by folding is carried out in a straightener which also makes it possible for the section obtained to be straightened in the conventional way.

According to another aspect of the present invention, the installation intended for the production of a section of the abovementioned type comprises at least:

a conventional rolling installation known per se, for carrying out the rolling until a blank close to finishing is obtained;

a mill stand comprising two rolls which are arranged in a plane essentially perpendicular to the plane of travel of the section part to be corrugated and at least one of which has a larger diameter over a central portion of its length, the said stand also possessing vertical rolls for the rolling of the said section which set the external dimensions of the latter;

a device for shaping by uniform and continuously repeated folding.

Advantageously, the device for shaping by folding comprises essentially two rolls or rollers which are arranged in a plane essentially perpendicular to the direction of travel of the section and which have a surface structured, preferably grooved or splined, in the axial direction over a length corresponding essentially to the portion of height of the corrugated part of the section to be produced.

According to an advantageous embodiment, the opposing structured rolls or rollers intermesh only slightly.

BRIEF DESCRIPTION OF THE FIGURES

The invention is described in more detail below by means of an exemplary embodiment supported by the drawings in which.

DETAILED DESCRIPTION OF PREFERRED EMBODIMENTS

In the Figures, identical reference symbols denote identical or similar elements.

In order to illustrate the present invention, this is described with regard to a rolled I-section with a corrugated web.

Figure 1:
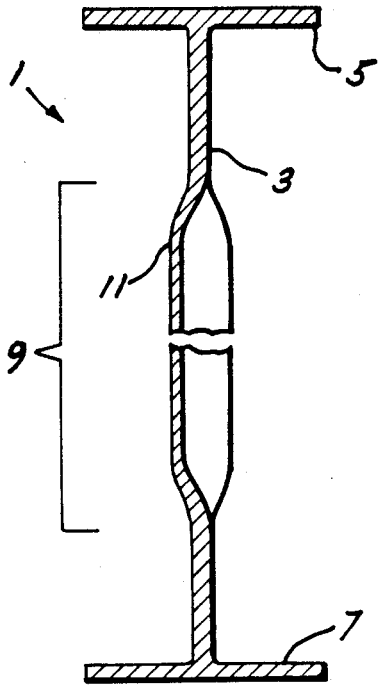
FIG. 1 is a sectional view through a rolled I-section, the web of which is corrugated over some of its height.
Figure 2:
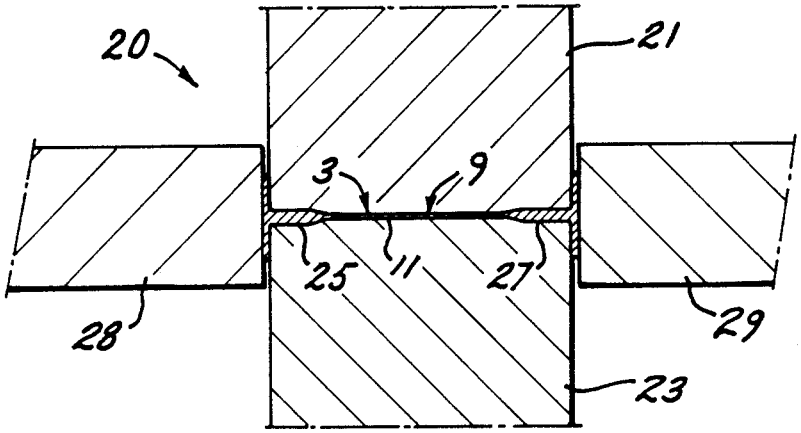
FIG. 2 is a diagrammatic view of the localized rolling of the rolled section.

FIG. 1 shows an I-section 1 comprising a web 3 and two chords 5 and 7 rolled in one piece with the web 3. The web 3, over a portion 9 of its height, has a corrugation 11 in the longitudinal direction of the I-section.

For the purpose of producing an I-section according to the invention, the said section 1 is passed between two rolls 21 and 23 arranged in a plane essentially perpendicular to the plane of the web 3 and forming part of a mill stand 20. The diameter of each of the two rolls 21 and 23 is larger over a portion 9 than at the ends 25 and 27. Moreover, the section 1 is further rolled by means of vertical rolls 28 and 29 which maintain the external dimensions of the section 1.

When a rolled section 1 is being passed through this stand until it reaches a stage close to finishing, the overall dimensions of the section must be maintained. The local contraction of the web causes an excess of material, whilst at the same time preventing a creep of the chords. This excess material generates stresses and a corrugation of the portion 9 of the web which are distributed locally over the web 11.

The section so obtained can subsequently be passed through a straightener 31 equipped, for example, with straightening rollers 33 to 38 arranged in a way known per se so as to make the rolled section straight.

Figure 3:
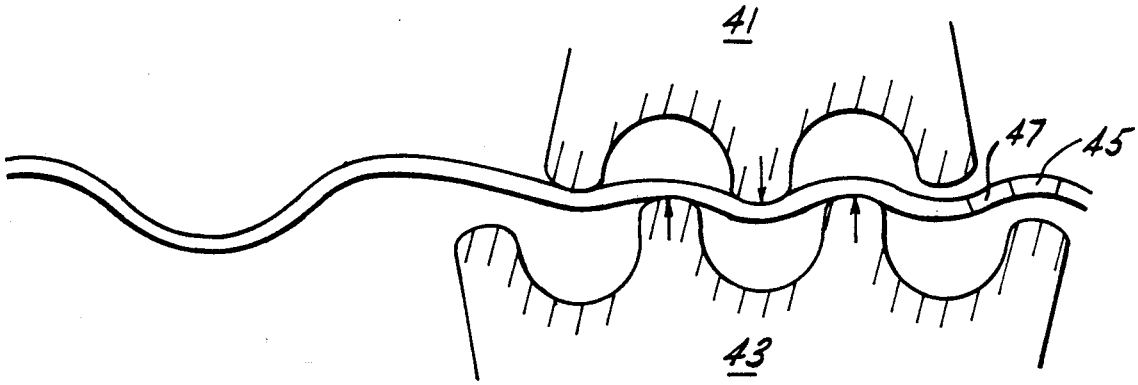
FIG. 3 is a diagrammatic view of the folding operation.
Figure 4:
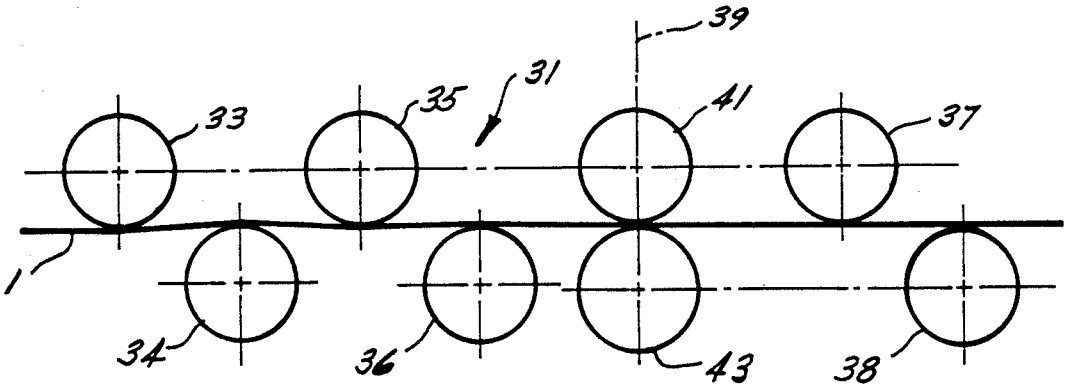
FIG. 4 is a diagrammatic view of the straightener used in the installation according to the present invention.

According to the present invention, the said straightening stand comprises two rollers 41 and 43 which are arranged in a plane 39 essentially perpendicular to the plane of travel of the section 1 and which have a surface grooved in the axial direction, being matched to one another in the manner of a gear and intermeshing only slightly so as to obtain a folding (FIG. 3).

In this step, the overlength produced previously between the rolls 21 and 23 is used to form the desired corrugation and to some extent neutralize the tensions previously generated.

This results in an I-section rolled in one piece and with a corrugated web which has very good mechanical properties and few internal tensions. The cold-straining stresses are especially reduced, as can be seen from FIG. 3 where the folding implies curved portions 45 and even linear portions 47, essentially without stress.

It may also be noted that one of the two rollers can be driven in rotation, whereas the other rotates freely.

I claim:

1. A process for making a longitudinally extending rolled section comprising:

(a) rolling a blank to near finished dimensions;

(b) passing the blank between a first pair of opposed rolls to elongate the blank, at least on of said rolls having a non-uniform diameter with a larger diameter over a portion of its length so that additional relative elongation is imparted to a portion of the blank to form corrugations on the blank; and (c) shaping the rolled section by uniformly and repeatedly folding the corrugations;

said rolled section exhibiting particular resistance to bending and buckling.

2. The process of claim 1, wherein the shaping is carried out by folding the corrugations between two between two opposed rollers which are arranged in a plane perpendicular to the longitudinal direction, said rollers having a structured surfaces.

3. The process of claim 2, wherein:

the surfaces of the rollers have axially grooved or splined surfaces over a length corresponding to the larger diameter portion of the roll or step (c).

4. The process of claim 3, wherein:

the rollers intermesh.

5. The process of claim 1 wherein step (b) further comprises limiting deformation of the blank in the direction parallel to the two rolls.

6. The process of claim 1, wherein the first pair of rolls are oriented perpendicularly to the longitudinal direction and wherein step (b) further comprises simultaneously passing the blank between a second pair of opposed rolls, said second pair of rolls being disposed at opposite ends of said first pair of rolls and being oriented in a direction perpendicular to said first pair of rolls and perpendicular to the longitudinal direction.

7. An apparatus for making a longitudinally extending rolled section, comprising:

a first pair of rolls arranged perpendicular to the longitudinal direction, at least one of said rolls having a non-uniform diameter with a larger diameter over a portion of its length to form corrugations on a blank passed between the rolls, and means for shaping the rolled section by folding the corrugations.

8. The apparatus of claim 3, wherein:

the shaping means comprises two opposed rollers arrange din a plane perpendicular to the the longitudinal direction, said rollers having structured surfaces.

9. The apparatus of claim 8, wherein:

the surfaces of the rollers have axially grooved or splined surfaces over a length corresponding to the larger diameter portion of the roll.

10. The apparatus of claim 9, wherein:

the rollers intermesh.

11. The apparatus of claim 8, wherein:

one of the rollers is driven in rotation, and the other roller is allowed to rotate freely.

12. The apparatus of claim 7, further comprising means for limiting deformation of the blank in the direction parallel to the first pair of rolls.

13. The apparatus of claim 12, wherein the means for limiting deformation comprises a second pair of opposed rolls disposed at opposite ends of the first pair of rolls and being oriented in direction perpendicular to the first pair of rolls and perpendicular to the longitudinal direction.

* * * * *